US005884571A

United States Patent [19]

Valadez et al.

[11] Patent Number: 5,884,571

[45] Date of Patent: Mar. 23, 1999

[54] HOOP AND INCLUDED CLAMPING DEVICE FOR AN EMBROIDERY MACHINE

[76] Inventors: Sofia Valadez; Juan Antonio Valadez, both of 7502 Vicky Dr., Whittier, Calif. 90606

[21] Appl. No.: 5,339

[22] Filed: Jan. 9, 1998

[51] Int. Cl.[6] ..... D05C 1/02; D06C 3/08

[52] U.S. Cl. ..... 112/103; 38/102.2

[58] Field of Search ..... 112/103, 470.14; 38/102, 102.2, 102.1, 102.91; 160/371, 378, 380, 402; 223/DIG. 2, 25; 269/2, 56, 58, 126, 131

[56] References Cited

U.S. PATENT DOCUMENTS

| | | | |
|---|---|---|---|
| 2,684,041 | 7/1954 | Tice | 112/103 X |
| 3,443,537 | 5/1969 | Becker et al. | 112/103 |
| 3,664,288 | 5/1972 | Weidlin von Boden et al. . | |
| 4,598,488 | 7/1986 | Inteso . | |
| 4,706,583 | 11/1987 | Darbenzo | 112/103 |
| 4,831,753 | 5/1989 | Inteso . | |
| 4,981,092 | 1/1991 | Bauman et al. . | |
| 5,129,171 | 7/1992 | Arbter et al. | 38/102.2 |
| 5,138,960 | 8/1992 | Inteso . | |
| 5,590,613 | 1/1997 | Head . | |

FOREIGN PATENT DOCUMENTS

| | | | |
|---|---|---|---|
| 581036 | 8/1958 | Italy | 38/102.1 |
| 422483 | 1/1935 | United Kingdom . | |

*Primary Examiner*—Ismael Izaguirre
*Attorney, Agent, or Firm*—Brown, Martin, Haller & McClain, LLP

[57] ABSTRACT

A machine embroidery hoop assembly which retains a fabric workpiece securely in place throughout the machine embroidery cycle without the use of tapes or structures that may cause harm to the fabric. The assembly fit easily within the machine and allows the operator to easily insert and remove the workpiece. The embroidery hoop includes two securing members, a main clamp to hold the wide end of the workpiece and an elastic restraint to hold the free end. The main clamp has a wide, spring loaded bar cooperating with a fixed support to keep the fabric taut over its width, while the elastic restraint keeps the fabric pulled flat, so that the embroidery can be properly applied. The main clamp can easily be manually raised and lowered so the workpiece can be quickly and easily positioned in the hoop and then removed after embroidery. The whole assembly is of low height and fits easily into embroidery machine. Since the assembly holding the workpiece is entirely self-contained, there are no temporary parts such as adhesive tape which can come loose and foul the machine.

20 Claims, 2 Drawing Sheets

HOOP AND INCLUDED CLAMPING DEVICE FOR AN EMBROIDERY MACHINE

BACKGROUND OF THE INVENTION

1. Field of the Invention

The invention herein relates to embroidery machinery. More particularly it relates to embroidery hoops used to hold individual workpieces while the workpieces are embroidered by the machines.

2. Description of the Prior Art

Embroidery has long been used to form decorative designs on fabrics by hand, and for commercial products, by machine. There are many commercial products made using embroidery machines, including garments, bed and bath linens, and decorative objects for home and office. One common product to which decorative embroidery is applied by machines is the baseball cap. Embroidery machines are used to apply team names and logos, as well as company names and logos, decorative names or initials, pictures of plants or animals, and many other designs.

Most embroidered products are assembled from several individual pieces of fabric. Before assembly, each piece of fabric which is to display an embroidered design, logo, etc. as part of the final product is inserted into a machine embroidery hoop and secured into the hoop. The hoop is then placed in a carrier which in turn is inserted into the embroidery machine in a position aligned with the embroidery needle, and the machine then applies the desired embroidered design, logo, etc. to the fabric in the normal manner. Once the embroidered design, logo, etc. is completed, the carrier is ejected from the machine. The operator then removes the hoop and separates the embroidered piece of fabric, which is then put with the other pieces of fabric to be assembled into the desired final product, such as a baseball cap. The hoop is then ready to receive a new unembroidered piece of fabric for the cycle to be repeated.

In the past it has been difficult to ensure correct alignment of the fabric workpiece in the hoop so that in the machine the embroidery can be properly applied. As a typical example, we can consider a baseball cap to which a team initial (such as the letter "O" in FIG. 1) is to be applied. For such a cap the workpiece is usually a triangular or rectangular piece of fabric which will ultimately be assembled as the front panel of the cap. It is common in the embroidery business for the workpiece to be secured into the hoop by use of adhesive tape. However, using adhesive tape causes numerous problems. Applying and subsequently removing the tape from the workpiece can damage the fabric; the tape often does not hold securely allowing the workpiece to shift position under the embroidery needle, so the embroidery becomes applied in the wrong location or the embroidery pattern becomes distorted; or pieces of the tape loosen and become stuck in the needles and inside the embroidery machine, so that the machine must be shut down to remove the tape. In addition, one must consider the cost of spoiled material and the operator's time spent changing, aligning and repositioning the tape for each new cycle, as well as the operator's time wasted in clearing the machine of displaced tape.

Numerous modifications have been made to machine embroidery hoops in an attempt to secure the workpieces better within the hoops, to avoid damage to the workpieces which come loose inside the machines, The possible modifications have been restricted, however, because the space within the machine to receive the hoop and carrier is very limited, especially as to height; in most machines the space for the hoop and carrier is only about 1" (25 mm) high. Prior inventors have produced a number of different devices which are disclosed in the prior art, but none of these has proved to be fully satisfactory. Typical examples of prior hoops are shown in U.S. Pat. Nos. 4,598,488 and 4,831,753 (both to R. N. Inteso). The Inteso hoops use toothed and clawed members as the elements for securing the workpiece. In order to work, such toothed or clawed members must necessarily dig into the workpiece fabric, thus marring the fabric and, if the fabric shifts during the operating cycle, possibly tearing the fabric. Use of the Inteso hoops also requires that machines be stopped fully for each hoop change, since the height of the Inteso hoops does not permit the repetitive reciprocating movement required without stopping the machine. This of course adds substantially to the length of each cycle and reduces the number of products which can be produced per unit of time.

It would therefore be very desirable to have a hoop structure which would hold a fabric workpiece securely so that it could be properly embroidered by the machine, but would hold the workpiece in a manner which would avoid any possible damage to the fabric and would allow free reciprocating movement without stopping the machine.

SUMMARY OF THE INVENTION

We have now invented a hoop assembly structure which provides for securely retaining the embroidery workpiece in place within the hoop throughout the entire cycle of inserting the hoop and workpiece into the machine, embroidery of the desired design, and removal of the hoop and embroidered workpiece from the machine. This new hoop assembly is unique in that it includes novel clamping elements which hold the workpiece securely without causing any harm to the fabric. The assembly has dimensions which allow it to fit easily within the machine recess, since the height of the assembly allows free reciprocating movement without stopping the machine, thus allowing the embroidery operator to easily and conveniently place and remove the workpiece. The new hoop assembly does not have any parts which can come loose within the machine, so that damage and fouling of the machine is prevented. Further, because the present assembly is so easily manipulated by the operator to insert and remove the workpiece, workpiece production rate is increased, the time needed per cycle decreases considerably, the quality of the product is enhanced and operator error is virtually eliminated.

In general terms, the device of this invention is an embroidery hoop to which are attached two clamping elements, the main one of which holds one end (usually the wider end) of the workpiece, and the other which holds the free end. The main clamping element is formed by a spring-loaded moveable bar which cooperates with a fixed support, keeping the fabric motionless and taut over most or all of its width. The second clamp is formed of one or more resilient bands, which keep the fabric pulled flat, so that the embroidery can be properly applied. The main clamp can be raised and lowered with one hand (and often just one finger), so the workpiece can be quickly and easily positioned in the hoop and then removed after embroidery. The whole assembly also has very little height, so that the hoop, the clamping elements and the workpiece can all fit easily into the machine's recess. Also, since the assembly is entirely self-contained, there are no separate parts which can come loose, get lost, or otherwise cause problems.

Therefore, in a broad embodiment, the invention is an embroidery hoop assembly to be received in an embroidery machine and for securing a workpiece to be embroidered in the embroidery machine, which comprises: a hoop having an outer side, an inner side, a top and a bottom, and surrounding and enclosing an interior space; a workpiece support having opposite ends and extending across the interior space and attached at the ends to the hoop; a moveable bar disposed generally parallel to the workpiece support, the bar hingedly mounted on a base, with the base attached to the hoop at a point intermediate the points of attachment of the support to the hoop; biasing means attached to the base for releasably urging the bar toward the support when a first portion of the workpiece is positioned therebetween; a workpiece restraint capable of receiving a second portion of a workpiece, having opposite ends and extending across the interior space and attached at the ends to the hoop at a location spaced apart from the workpiece support by a distance greater than the corresponding dimension of the area of the workpiece onto which embroidery is to be applied; and the hoop assembly having overall outer dimensions less that internal dimensions of the portion of the embroidery machine into which the assembly is to be received; whereby a workpiece may be placed in the hoop, with the first portion thereof disposed between the support and the bar and secured in place by the action of the biasing means urging the bar into close proximity to the support and causing a clamping action therebetween, and the second portion thereof positioned restrained by the workpiece restraint, such that the area of the workpiece disposed between the first and second portions is secured against movement when the assembly containing the workpiece is received in the machine during application of the embroidery.

DETAILED DESCRIPTION AND PREFERRED EMBODIMENTS

Figure 1:
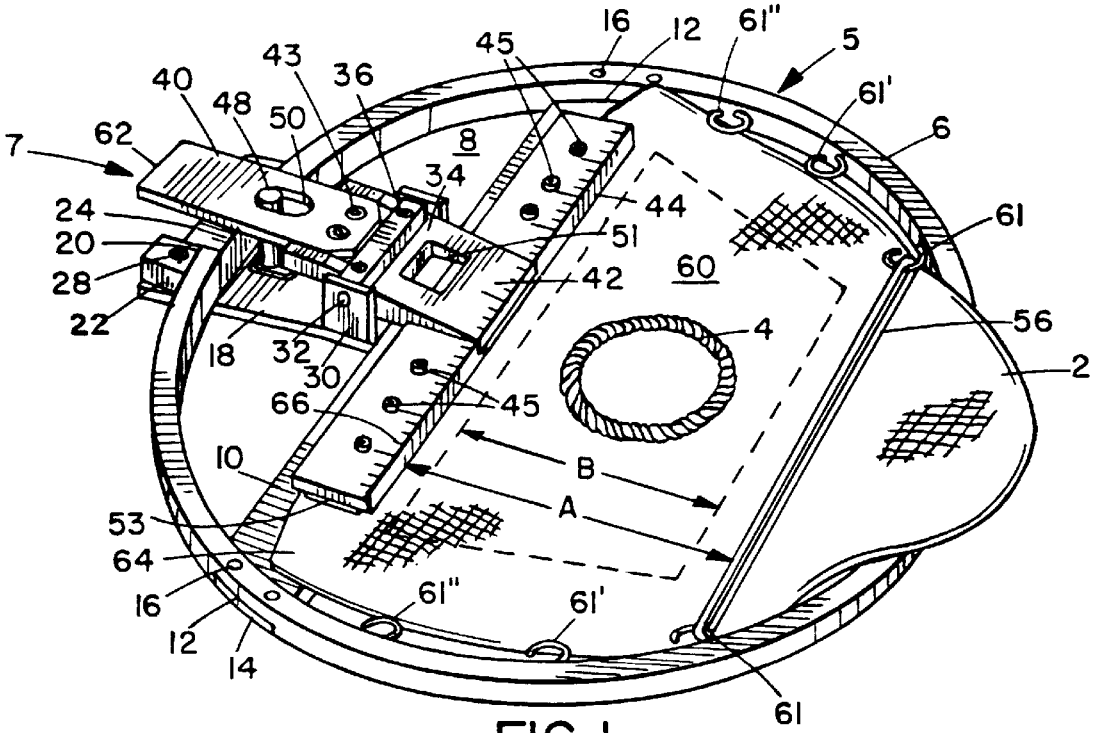
FIG. 1 is a perspective view of an embroidery hoop and securing clamp assembly of the present invention, showing a workpiece to be embroidered secured in place.

The hoop assembly of the present invention will be best understood by reference to the drawings. In these drawings, the workpiece to be embroidered will be exemplified by a generally triangular workpiece 2 of the type which can be subsequently assembled with other similar pieces of fabric to form a baseball cap (not shown), with the embroidered workpiece 2 forming the front of the cap. In this example, the embroidery on the workpiece will be represented by a simple circle or letter "O" of embroidery, designated 4. It will be recognized, of course, that this circle 4 represents a very simple example for the purpose of this description. Much more detailed and complex embroidery designs may be applied to the workpieces 2 and many more types of products other than simple baseball caps may be made using machine embroidery, all of which is well known and need not be further detailed here.

The basic part of the assembly of the present invention is a hoop 5 which has the same general overall dimensions as a conventional machine embroidery hoop. Such hoops are normally circular in plan with relatively narrow and low wall 6 as shown. By tradition, embroidery hoops are circular (annular) and virtually all embroidery machines are designed to accept circular hoops. The present invention, however, will be equally applicable if another shape of hoop 5 is used, such as one having a square, hexagonal, octagonal or other polygonal shape. For brevity herein, however, the hoop 5 will be referred to as circular or annular. Also, as will be illustrated, wall 6 is generally not continuous, but has a single break, in which is mounted the main clamp structure 7. If it is desired to make the wall 6 continuous, then the attachment of the main clamp structure to the wall will be modified accordingly, as will be evident to those skilled in the art.

The interior area within the wall 6 of the hoop 5 consists primarily of open space 8. Within that space a transverse support 10 is disposed across the hoop and attached at its opposite ends to the hoop wall 6 as indicated at 12. The transverse support 10 may be attached to the inside of the hoop wall 6 or, preferably, will be seated in a recess 14 formed in the bottom of the hoop wall 6 and secured into the recess 14 by machine screws 16.

Integrated with support 10 or attached to it, preferably at its midpoint, is a base 18 which projects generally perpendicularly from the support 10 and is secured to the hoop wall 6 at a point 20, which conveniently may be midway between the attachment points 12 for support 10. In the embodiment shown in the drawings, the base 18 is secured to the hoop 6 by passing under two flanges 22 projecting from split wall 6 adjacent to the gap 24 in the wall 6. The gap 24 is filled by a block 26 attached to base 18. The flanges 22 and base 18 are secured together by machine screws 28. This type of mounting permits easy insertion and removal of the main clamp structure yet keeps the circular configuration of hoop 5 intact and prevents spreading of the hoop wall 6.

Mounted on base 18 (normally by screws—not shown—from the underside of base 18) is an upstanding pair of brackets 30 each of which contains a journal hole 32. Lever arm 34 is formed of a pivot member 36 having at each end thereof pivot pins or trunnions 38 which fit into and are journaled in holes 32. Pivot bar 36 in turn is attached to clamping member 42, which extends on both sides of pivot bar 36. Lever arm 40 is attached to the outward extension of clamping member 42 by screws 43 and extends generally from adjacent to the pivot arm 36 outwardly to and past the wall 6. On its inward extension from pivot bar 36, clamping member 42 is generally T-shaped and includes an elongated bar or plate 44 which is aligned with support 10 and has opposite ends extending toward but not actually contacting wall 6. The bottom face 46 of bar 44 is conFigured such that when a workpiece 2 is in place between bar 44 and support 10, the face 46 of bar 44 will be parallel to the top surface of support 10 so that a clamping action (to be described below) will be applied strongly and evenly across that portion of workpiece 2 which is received between the support 10 and bar 44. Screws 45 are used to secure support 10 to bar 44 over their lengths, to insure that any possible unevenness in support 10 is avoided. A post 48 projecting through a slot 50 is conveniently mounted on base 18 as a guide for the pivoting lever structure 34. Also it is useful to incorporate the aperture 51 in member 42, so that the position of the workpiece segment being clamped can be visually observed.

Figure 3:
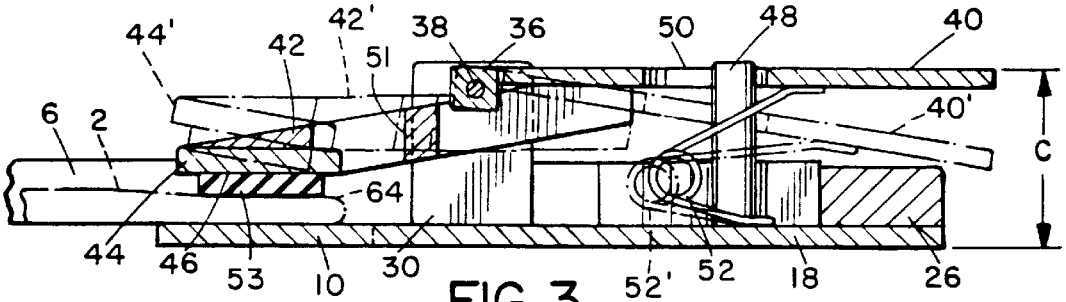
FIG. 3 is an enlarged sectional view taken on Line 3—3 of FIG. 2.

In the embodiment shown, post 48 is also used to secure spring 52 in position. Spring 52 is a coil or leaf compression spring, or preferably, as shown, a torsion spring, which is in contact with both base 18 and lever arm 40. When the operator depresses lever arm 40 to position 40' (as shown in FIG. 3) to allow insertion or removal of the workpiece 2, the spring 52 shifts to position 52', and when the operator releases lever arm 40, the spring 52 resiles and urges lever arm 40 upwards, thus causing bar 44 to be urged and biased downward into clamping relationship with the workpiece 2 by cooperation with base 18. The corresponding movement of member 42 and bar 44 are shown respectively at 42' and 44' in FIG. 3. Preferably there will be a layer of rubber or other elastomer or similar polymer 53 secured to the underside 46 of bar 44 to provide a gripping surface to aid in securing and clamping workpiece 2. Alternatively, the underside 46 of bar 44 may be configured with numerous small blunt protuberances 54 which are commonly hemispherical or semiellipsoidal. These will press into the fabric of workpiece 2, but because they are blunt and not sharp like the prior art teeth or claws, they will not harm the fabric, while still providing for additional enhanced securing of the fabric in place.

The strength of spring 52 will be sufficient to strongly urge the bar 44 into clamping cooperation with the support 10 to secure the workpiece 2 during the entire machine embroidery cycle, but will not be so strong that it prevents convenient hand or finger manipulation of the lever arm 40 by the operator to insert and remove workpieces 2.

Spaced apart from the support 10 and bar 44 on the opposite side of the hoop 5 is a workpiece restraint member 56, which is used to secure the free end 58 of the clamped workpiece 2 in position so that the entire embroidery area 60 (generally indicated by dashed lines in FIGS. 1 and 4) will be held taut and free from excessive motion during the machine embroidery cycle while the design or pattern 4 is formed. As will be evident from FIG. 1, the dimension A by which the support 10 and bar 44 are separated from restraint 56 must be greater than the width B of the intended embroidery area 60. Preferably restraint 56 is formed of a strong, somewhat flexible elastic band such as a rubber band 57. In the embodiment illustrated, rubber band 57 is shown as looped through an opposed pair of hooks 61 which are part of a plurality of pairs of hooks 61, 61', 61", etc. which are attached at spaced apart locations around the wall 6 of the hoop. The pairs of hooks 61, etc. insure that the restraint 56 will retain its alignment and position opposite bar 44 and support 10. Means of releasably securing the restraint 56 to the hoop 6 other than hooks 61, etc. may be used, as long as the alternative means does not interfere with the operation of the hoop and the embroidery machine.

Figure 2:
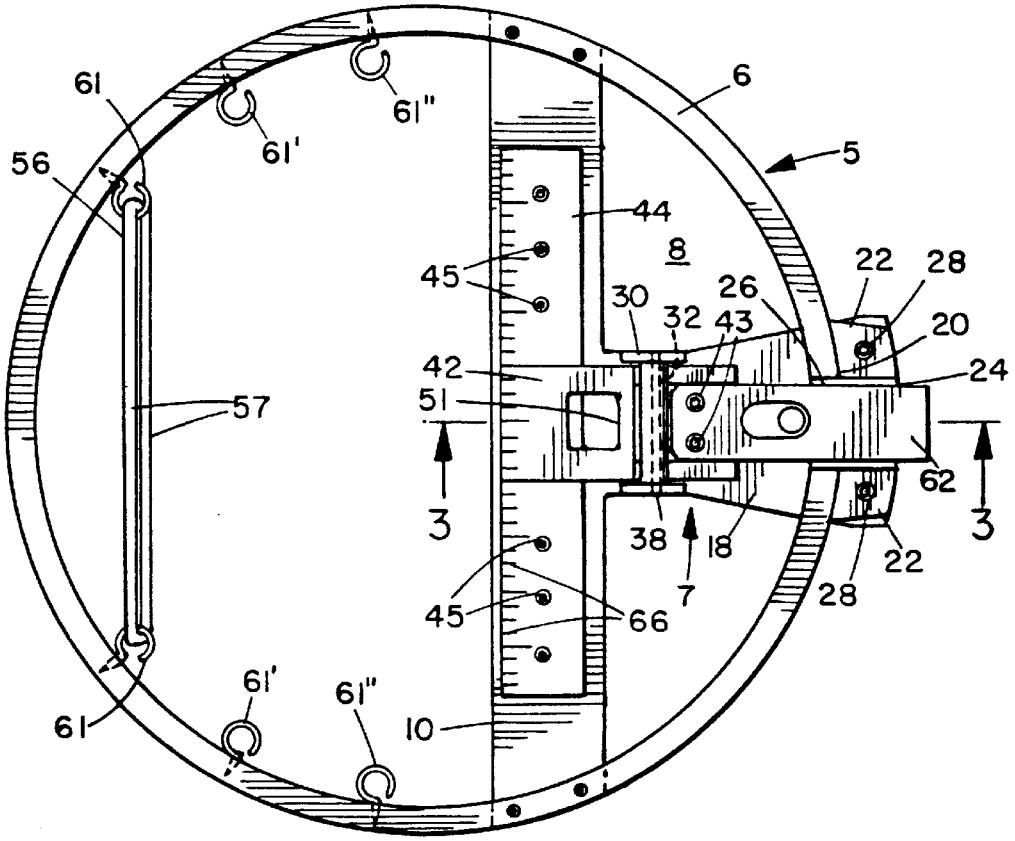
FIG. 2 is a top plan view of the hoop and clamp assembly of FIG. 1, with the workpiece not shown.

The relative positions of the elements of the present invention are generally as shown in FIG. 2, although some variation is permissible. The main clamping mechanism 7 containing bar 44 and support 10 is generally positioned with the support 10 near but not at the center of the hoop 6, to provide sufficient room for base 10, spring 52 and pivot mechanism 34 to be positioned within the inside of hoop wall 6, so that only the terminal portion 62 of lever arm 40 and the flanges 22 and connecting portion 24 of base 18 projects outside the hoop wall 6. This positioning provides for accommodation of the broadest width of clamped end 64 of workpiece 2 without extending beyond the confines of hoop 5 and thus interfering with the operation of the embroidery machine. The position of restraint 56 will be chosen such that a suitable portion of the free end 58 of workpiece 2 can be inserted under the support 56, but close enough to the hoop wall 6 that the restraint 56 will securely hold free end 58 of the fabric against excessive motion during the embroidery cycle. It will be understood that in appropriate situations, such as a very flexible workpiece material, it may be useful to use more than one restraint 56, with each restraint attached to a different pair of hooks 61, etc. and spaced apart to provide sufficient clearance for the embroidery needles to produce the desired pattern 4. The particular locations and dimensions of the elements of the invention can be readily determined by those skilled in the art, and may be variable within well understood limits. Important factor in determining the positions of the elements will be the size, type, shape and stiffness of the fabric of workpiece 2.

Preferably all of the elements other than restraint 56 and spring 52 will be made of a relatively rigid materials such as metal or one of the more rigid plastics. Typical suitable metals may be aluminum, steel, copper, brass or any of a number of alloy materials. Similarly, relatively rigid plastics such as ABS, PVC and polycarbonate may be used to advantage. Spring 52 will, of course, be a resilient spring made of either coiled or flat plate spring metal. As noted, restraint 56 is shown as a strong rubber or elastomeric band 57, but it may also be made out of a more rigid material. For instance, one could hinge a bar at one of the positions 60 with an interference fit of the other end of the bar at the opposite edge against wall 6, or forming a slot (not shown) in wall 6 into which a corresponding tab on the end of the bar would fit. For ease of operation, however, the strong rubber band or similar elastomeric material shown in the Figures is preferred.

Figure 4:
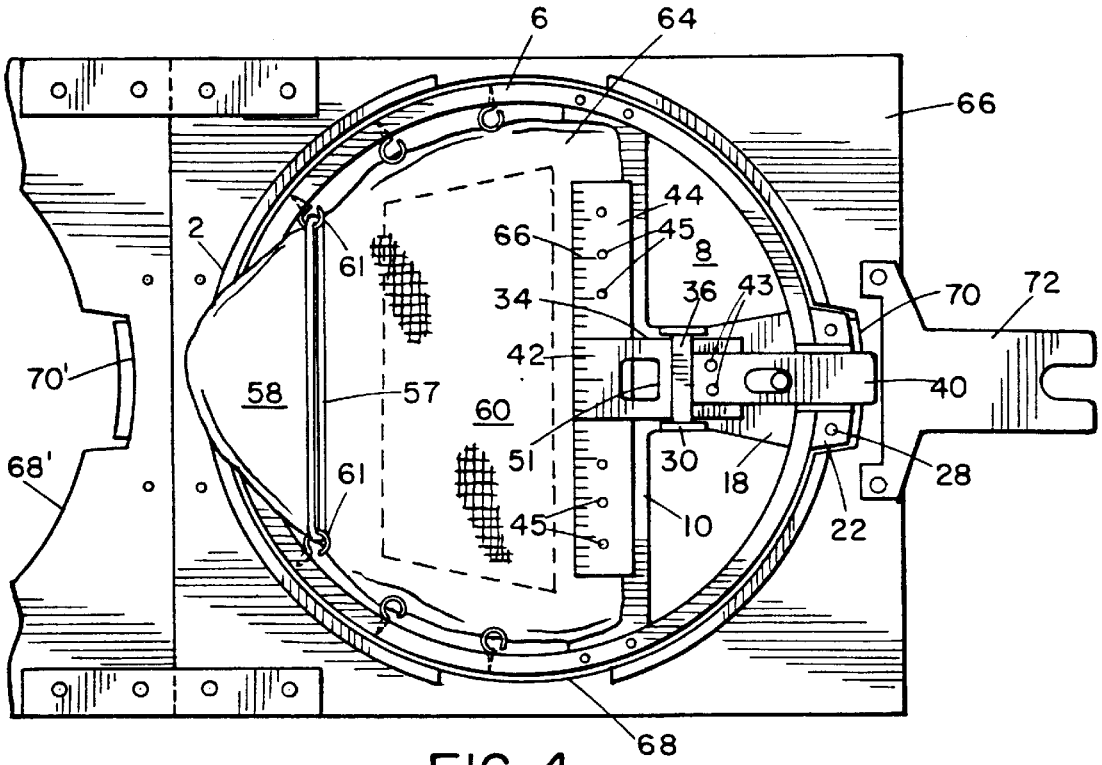
FIG. 4 is a top plan view showing the hoop and clamp assembly, with a workpiece in place, installed in a carrier for insertion into an embroidery machine.
Figure 5:
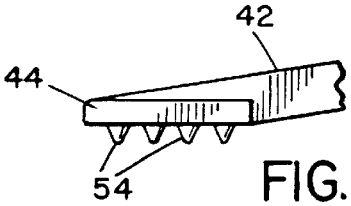
FIG. 5 is an end elevation view of the bar portion of the clamping structure of an embodiment of the invention, illustrating alternative gripping means.

The operation of the device is best understood by reference to FIGS. 3 and 4. At the beginning of a cycle, the operator presses down on lever 40 to open the space between support 10 and bar 44 (or resilient member 46, if present) to position 44' so that the (wider) edge 64 of workpiece 2 may be slid into position between the bar 44 and support 10. Proper alignment of the end 64 may be enhanced by reference to indicia 66 which may be placed on the top of bar 44 in the manner shown in FIGS. 1 and 4. Indicia 66 may be specific English or metric measurements or specific reference marks (such as a centerline) related to the desired embroidery area. Once the end 64 of workpiece 2 is properly aligned in position, the operator releases lever arm 40 and the biasing action of spring 52 forces the bar 44 and optional resilient material 46 downwardly, compressing the end 64 of workpiece 2 against the top surface of support 10 so that the workpiece 2 is firmly held in place. The biasing action of the spring 52 is strong enough to keep the end 64 of the workpiece 2 from shifting. The operator then takes the free end 58 of workpiece 2 and threads it under the restraint 56 and over the top of hoop wall 6, pulling it tight against the restraint 56, so that the embroidery area 60 is held smooth and taut.

The operator then takes the entire hoop assembly including the clamped workpiece 2, and places it in a corresponding recess in machine carrier 64. In the embodiment shown the recess 68 has a notch 70 to receive the extended portion of the hoop 6 including the flanges 22 and extended portion of support 18 and block 24. This notch 70 also serves to align the circular hoop assembly in the correct orientation for embroidery within the area 60. Commonly carriers 64 have accommodation for more than one hoop 6, as shown in FIG. 4 by the partial view of a companion recess 68' with a corresponding notch 70' for second hoop. Carriers 66 normally also have auxiliary elements such as a guide 72 to facilitate their insertion into and ejection from the embroidery machine (not shown). Once the hoop assembly and contained workpiece 2 are inserted into the carrier 66, the operator inserts the carrier 66 into the embroidery machine either by hand or mechanically and the carrier moves into the proper position with area 60 of the workpiece 2 aligned with the embroidery needle or needles. The embroidery machine then applies the embroidery of the preprogrammed design 4 in a conventional manner. Once the embroidery application is completed, the embroidery cycle continues as the carrier 66 is ejected from the machine. The operator then removes the hoop 5 from the carrier, pulls the free end 58 of the now embroidered workpiece 2 out from beneath the restraint 56 and pushes the lever arm 40 to raise the bar 44 and resilient member 46 so that the end 64 of workpiece 2 can be moved out of the clamped position and the entire workpiece removed from the hoop assembly. The cycle is thus completed and the hoop 6 is ready for the start of a new cycle in which a new unembroidered workpiece 2 is placed into the hoop 6 in the same manner for subsequent embroidering.

It will be evident from the above that there are numerous embodiments of this invention which, while not expressly set forth above, are clearly within the scope and spirit of the invention. The above description is therefore intended to be exemplary only and the scope of the invention is to be determined solely by the appended claims.

We claim:

1. An embroidery hoop assembly to be received in an embroidery machine and for securing a workpiece to be embroidered in said embroidery machine, which comprises:

a hoop having an outer side, an inner side, a top and a bottom, and surrounding and enclosing an interior space;

a workpiece support having opposite ends and extending across said interior space and attached at said ends to said hoop;

a moveable bar disposed generally parallel to said workpiece support, said bar hingedly mounted on a base, with said base attached to said hoop at a point intermediate the points of attachment of said support to said hoop;

biasing means attached to said base for releasably urging said bar toward said support when a first portion of said workpiece is positioned therebetween;

a workpiece restraint capable of receiving a second portion of a workpiece, having opposite ends and extending across said interior space and attached at said ends to said hoop at a location spaced apart from said workpiece support by a distance greater than the corresponding dimension of the area of the workpiece onto which embroidery is to be applied; and said hoop assembly having overall outer dimensions less that internal dimensions of the portion of said embroidery machine into which said assembly is to be received;

whereby a workpiece may be placed in said hoop, with said first portion thereof disposed between said support and said bar and secured in place by the action of said biasing means urging said bar into close proximity to said support and causing a clamping action therebetween, and said second portion thereof positioned restrained by said workpiece restraint, such that the area of said workpiece disposed between said first and second portions is secured against movement when said assembly containing said workpiece is received in said machine during application of said embroidery.

2. A hoop assembly as in claim 1 wherein said biasing means comprises a spring.

3. A hoop assembly as in claim 1, wherein said support and said bar comprise generally flat elongated members with parallel opposed faces, and when said bar is urged toward said support by said biasing means said parallel faces form a clamp securing a workpiece placed therebetween against motion.

4. A hoop assembly as in claim 1 wherein said hoop is annular or polygonal in plan.

5. A hoop assembly as in claim 4 wherein said hoop is annular in plan.

6. A hoop assembly as in claim 1 further comprising said base comprising a hinge to which said bar is mounted and one which it pivots, and a lever attached to said bar and also hingedly mounted on said hinge and pivoting with said bar, said lever extending from bar past said hinge to a terminal end on the opposite side of said hinge from said bar, such that manipulation of said terminal end of said lever counteracts the urging action of said biasing means and urges said bar away from said support allowing release of any workpiece disposed therebetween.

7. A hoop assembly as in claim 1 wherein said hoop is annular in plan and said support and said restraint are disposed on opposite sides of a diameter of said hoop.

8. A hoop assembly as in claim 1 wherein the length of said support between its end attachment points to said hoop is greater than the length of said restraint between its end attachment points to said hoop.

9. A hoop assembly as in claim 1 wherein said ends of said support are attached to the inner side of said hoop.

10. A hoop assembly as in claim 1 wherein said ends of said support are attached to the bottom of said hoop.

11. A hoop assembly as in claim 10 wherein said bottom of said hoop has recesses formed therein and said ends of said support are received in said recesses.

12. A hoop assembly as in claim 1 further comprising indicia indicating correct alignment of said workpiece in said assembly.

13. A hoop assembly as in claim 12, wherein said indicia are associated with said bar.

14. A hoop assembly as in claim 1 wherein said hoop, support, bar and base are formed of at least one substantially rigid material.

15. A hoop assembly as in claim 14 wherein said material comprises a metal or plastic.

16. A hoop assembly as in claim 1 wherein said workpiece restraint comprises a band formed of an elastic material.

17. A hoop assembly as in claim 16 further comprising a plurality of hooks emplaced in said inner side of said hoop for releasably securing said workpiece restraint in its operational position.

18. A hoop assembly as in claim 1 wherein a face of said bar facing said support has emplaced thereon gripping means for enhancing clamping action against said workpiece created by the urging of said bar toward said support by said biasing means.

19. A hoop assembly as in claim 18 wherein said gripping means comprises a body of elastomeric material adhered to said face of said bar.

20. A hoop assembly as in claim 18 wherein said gripping means comprises protuberances on said face and extending outwardly therefrom toward said support.

* * * * *